US011149443B2

(12) United States Patent
Boucké

(10) Patent No.: US 11,149,443 B2
(45) Date of Patent: Oct. 19, 2021

(54) PANEL AND COVERING

(71) Applicant: I4F Licensing NV, Hamont-Achel (BE)

(72) Inventor: Eddy Alberic Boucké, Menen (BE)

(73) Assignee: I4F International B.V., Grebbeweg (NL)

( * ) Notice: Subject to any disclaimer, the term of this patent is extended or adjusted under 35 U.S.C. 154(b) by 0 days.

(21) Appl. No.: 16/649,209

(22) PCT Filed: Sep. 17, 2018

(86) PCT No.: PCT/EP2018/075092
§ 371 (c)(1),
(2) Date: Mar. 20, 2020

(87) PCT Pub. No.: WO2019/057672
PCT Pub. Date: Mar. 28, 2019

(65) Prior Publication Data

US 2020/0299973 A1 Sep. 24, 2020

(30) Foreign Application Priority Data

Sep. 22, 2017 (NL) ..... 2019609

(51) Int. Cl.
*E04F 15/02* (2006.01)

(52) U.S. Cl.
CPC .. *E04F 15/02038* (2013.01); *E04F 15/02022* (2013.01); *E04F 2201/0146* (2013.01); *E04F 2201/041* (2013.01); *E04F 2201/045* (2013.01)

(58) Field of Classification Search
CPC ..... E01C 11/106; E01C 11/126; E01C 11/14; E04F 15/02194; E04F 15/142; E04F 15/02038; E04F 15/02022; E04F 2201/0146; E04F 2201/041; E04F 2201/045; E04F 2201/0138; E04B 5/32; E04B 2005/322; E04B 2005/324; E04B 2005/173; E04G 13/00; E04G 21/185
See application file for complete search history.

(56) References Cited

U.S. PATENT DOCUMENTS

| | | | | |
|---|---|---|---|---|
| 7,896,571 | B1 | 3/2011 | Hannig et al. | |
| 9,885,187 | B2 * | 2/2018 | Kell | E04F 15/02038 |
| 10,072,428 | B2 * | 9/2018 | Devos | E04F 15/02038 |
| 2008/0241440 | A1 * | 10/2008 | Bauer | E04F 15/024 428/33 |
| 2014/0033633 | A1 | 2/2014 | Kell | |
| 2016/0069086 | A1 | 3/2016 | Hullenkremer et al. | |
| 2020/0232226 | A1 * | 7/2020 | De Rick | E04F 15/102 |

FOREIGN PATENT DOCUMENTS

| | | | | |
|---|---|---|---|---|
| CA | 2996422 | A1 * | 3/2016 | E04F 15/02033 |
| EP | 3581731 | A1 * | 12/2019 | E04F 15/02038 |
| WO | WO-2004005648 | A1 * | 1/2004 | E04F 15/04 |
| WO | WO-2012126046 | A1 * | 9/2012 | E04F 15/04 |
| WO | 2012136021 | A1 | 10/2012 | |
| WO | WO-2014033628 | A1 * | 3/2014 | E04F 15/045 |

* cited by examiner

*Primary Examiner* — Jessie T Fonseca
(74) *Attorney, Agent, or Firm* — The Webb Law Firm

(57) ABSTRACT

The present invention relates to a panel, in particular a floor panel, interconnectable with similar panels for forming a covering. The invention also relates to a covering consisting of mutually connected floor panels according to the invention.

17 Claims, 3 Drawing Sheets

PANEL AND COVERING

CROSS-REFERENCE TO RELATED APPLICATIONS

This application is the United States national phase of International Application No. PCT/EP2018/075092 filed Sep. 17, 2018, and claims priority to The Netherlands Patent Application No. 2019609 filed Sep. 22, 2017, the disclosures of which are hereby incorporated by reference in their entirety.

BACKGROUND OF THE INVENTION

Field of the Invention

The invention relates to an interconnectable panel, in particular a floor panel. The invention also relates to a covering, in particular a floor covering, comprising a plurality of interconnected panels according to the invention.

Description of Related Art

Interconnectable panels, such as interconnectable floor panels, are generally joined mechanically at edges of the panels by using complementary coupling profiles at opposite edges. Traditionally, rectangular floor panels are connected at the long edges by means of a traditional angling method. On the short side, the different coupling mechanisms can be applied, wherein a short edge coupling mechanism may, for example, be based upon vertical folding, also referred to as a drop down, wherein a downward tongue located at a short edge of a panel to be coupled is moved in downward direction, such that said downward tongue is inserted into an upward groove located at a short edge of a panel already installed. An example of such a panel is disclosed in U.S. Pat. No. 7,896,571, wherein a short edge coupling mechanism is shown being configured to vertically lock mutually coupled short edges of adjacent panels. Although this aimed vertical locking effect at the short edges is intended to stabilize the coupling between floor panels at the short edges, in practice often breakages, due to coupling edges being put under tension both during assembly and during practical use, occur at the coupling edges, which affects the reliability and durability of this type of drop down coupling.

An object of the invention is to provide an improved panel which can be coupled in improved manner to an adjacent panel as well as uncoupled in an improved way.

SUMMARY OF THE INVENTION

The panel according to the invention is provided with an improved drop down coupling mechanism with respect to known drop down coupling mechanisms. More in particular, the coupling mechanism is still configured to lock coupled panels both in horizontal and vertical direction due to the presence of the upward tongue having an inclined (inner) side facing toward the upward flank, and due to the presence of an inclined side of the downward tongue facing toward the downward flank, as a result of which the downward tongue will be secured within the upward groove. This first locking mechanism is also referred to as an inner lock, and forms a closed groove locking system. The upward tongue and the downward groove provide a horizontal locking mechanism, or second locking mechanism.

The upward flank being provided with a first locking element in the form of a rounded recess, and the downward tongue being provided with a second locking element in the form of a rounded bulge provides an additional locking mechanism, or third locking mechanism. This third locking mechanism may provide both a locking in vertical direction, as well as a locking in a rotational direction, preventing unwanted uncoupling of two coupled panels upon slight mutual rotation. The bulge and recess are typically arranged to be at least partially in contact in a coupled condition, in order to provide the locking effects.

Both the rounded recess and the rounded bulge are embodied as circular segments, which means that the outside of these elements form part of a virtual circle, and the outside of these elements is arc-shaped. This circle has a middle, or centre, and a closed curve around the circle at a certain radius. The centre of the first circle, defined by the first circular segment of the rounded recess, is located within the upward groove and the centre of the second circle, defined by the second circular segment of the rounded bulge, is located within the downward tongue. The location of these centres results in a relative smooth transition from upward flank to first locking element and from downward tongue to second locking element, at least compared to circle centres which are located outside the given locations, or at the edges thereof. The relative smooth transitions allow for a relative smooth coupling of two adjacent panels, preventing unnecessary strain and stress on the panels during coupling.

The centre of the first circle may be located below the upper side of the upward tongue and/or the centre of the second circle may be located below the upper side of the downward groove. At horizontal level of the circle, the rounded bulge extends the furthest, and may thus provide the most resistance during coupling of two panels. By providing an off-set between the centre of the first circle with regard to the upper side of the upward tongue, any resistance during coupling due to the upper side of the upward tongue is encountered before resistance of the rounded bulge. The same holds for the second circle and the downward groove.

In a coupled condition the part of the side of the upward tongue facing toward the upward flank and the part of a side of the downward tongue facing toward the downward flank may be in contact in a contact zone, wherein the centre of the first and/or second circle is located above the contact zone. The side of the upward tongue facing toward the upward flank and the part of a side of the downward tongue facing toward the downward flank are inclined and form part of the first locking mechanism and provide a vertical locking in coupled condition. These parts of two coupled panels are typically in contact and the area in which these parts are in contact defines a contact zone. During coupling, these inclined nature of these parts generally requires an at least temporary deformation of the coupling parts, and thus requires resistance to be overcome. At horizontal level of the circle, the rounded bulge extends the furthest, and may thus provide the most resistance during coupling of two panels. By providing an off-set between the centre of the first circle with regard to the contact zone, any resistance during coupling due to the inclined parts in the contact zone is encountered after resistance of the rounded bulge.

The upward flank may be oriented substantially vertically and may be provided with the first locking element in the form of the rounded recess and/or the side of the downward tongue facing away from the downward flank may be oriented substantially vertically and may be provided with the second locking element in the form of the rounded bulge. Applying substantially vertical surfaces in both coupling parts has the advantage that in the coupled position the coupling parts can connect to each other in relatively close-fitting and firm manner.

The width of the downward groove may be larger compared to the width of the upward tongue, such that in coupled condition a space may exist between the downward flank and a side of the upward tongue facing away from the upward flank. Due to the inclination of the coupling parts in the closed groove system, the coupling parts are typically deforms at least temporarily during coupling of adjacent panels. By providing a broader downward groove with respect to the upward tongue, the upward tongue has space to deflect towards the downward flank of the adjacent panel during coupling. This deflection temporarily widens the upward groove in order to allow entry of the downward tongue of the adjacent panel in the upward groove. After entry, the upward tongue may move back towards its original position, closing the upward groove again.

The upward tongue may be connected to the core of the panel by a first bridge part, and the downward tongue may be connected to the core of the panel by a second bridge part, wherein the maximal thickness of the first bridge may be less than the maximal thickness of the second bridge part. The bridge parts, and in particular the first bridge part, may be resilient. When one of the bridge parts is thinner compared to the other bridge part, deformation of the bridge part typically occurs first, or only, at the thinnest part. At that bridge part the least amount of material is present, and therefore deformation is easier at that bridge part. In particular when the coupling parts allow for temporary deflection of the upward tongue towards the downward flank of an adjacent panel, deformation of the first bridge part is desired, such that the first bridge part may be embodied thinner compared to the second bridge part.

The central angle of the first circle segment may lie between 20 and 80 degrees, in particular between 30 and 70 degrees, more in particular between 45 and 65 degrees, and/or the central angle of the second circle segment may lie between 25 and 85 degrees, in particular between 35 and 75 degrees, more in particular between 50 and 70 degrees. The central angle is the angle defined by the end points of the circular segment and the centre of the circle. These angles result in relative small sections of the circle to be part of the circle segment, which in turn results in relative smooth transition and relative small curvatures of the circle segments, which allows an easy coupling as well as uncoupling if desired, but in turn also allows sufficient locking.

The central angle of the first circle segment may be less than the central angle of the second circle segment, wherein in particular the central angle of the first circle segment may be about 60 degrees, and wherein the central angle of the second circle segment may be about 65 degrees. A difference in central angle between both circle segments results in one of the segments to be somewhat larger compared to the other, or the circle segment of the bulge to be somewhat larger compared to the circle segment of the recess, allowing optimal contact between the bulge and recess in a coupled condition.

An upper part of the upward flank and an upper part of a side of the downward tongue facing away from the downward flank may define a vertical plane in coupled condition, and the distal part of the second locking element may protrude beyond the vertical plane, wherein preferably the centre of the first and/or second circular segment may be located halfway the distance between the vertical plane and the side of the downward tongue facing toward the downward flank. The centre of the second circular segment may thus be located in the middle of the downward tongue, resulting in a relative shallow curvature of the rounded bulge.

The outermost part of the second locking element may define a horizontal level, wherein the centre of the first and/or second circular segment may be located at said horizontal level. The horizontal level may for instance be a level parallel to the plane of the panel, through the point of the outermost part of the second locking element, or rounded bulge. When the centre of the first or second circular segments lies on the same horizontal level compared to the outermost part of the second locking element, the second locking element is symmetrical around the horizontal level, or at least not skewed, which facilitates production of the coupling part.

An upper part of the upward flank and an upper part of a side of the downward tongue facing away from the downward flank may define a vertical plane in coupled condition, wherein the second locking element may located below the upper part of the side of the downward tongue facing away from the downward flank and wherein preferably an empty space may be provided between the upper part of the side of the downward tongue facing away from the downward flank and the second locking element. Such empty space may for instance be used to collects dust or other particles which would otherwise impede coupling of adjacent panels or their locking strength.

The total thickness of the panel may be between 1.5 and 5 times the radius of the circular segment, in particular between 2 and 4 times, more in particular between 2 and 3 times. Besides the core, the panel may for instance comprise decorative layers, wear layers, backing layers, overlay and/or protective layers, contributing to the total thickness of the panel. The provided ratio provides a relative shallow curvature of the rounded parts, enabling a relative easy coupling of adjacent panels. The panel may for instance be between 2.5 and 10 mm thick, and may be made of any material, such as MDF, HDF, plastic, plastic composites, WPC, mineral board, Magnesium Oxide board, gypsum or wood.

The part of a side of the upward tongue facing toward the upward flank, which is inclined toward the upward flank, and the side of the downward tongue facing toward the downward flank, which is inclined toward the downward flank, may define a closed groove system, wherein preferably the part of the side of the upward tongue facing toward the upward flank is directed upward towards the upper side of the panel, and wherein preferably the side of the downward tongue facing toward the downward flank is directed downward towards the bottom side of the panel. The closed groove system allows for a vertical locking of two coupling panels.

The downward flank may be substantially planar and, preferably, free of locking elements. Such downward flank is relatively easy to produce, and allows for instance the upward tongue to deflect towards the downward flank without encountering locking elements at the downward flank.

The upper side of the upward tongue and the upper side of the downward groove may be spaced apart in coupled condition. The space created may act to collects dust or other particles which would otherwise impede coupling of adjacent panels or their locking strength, but may also be used to allow the materials to move or expand slightly, which could be a distinct advantage when the panels are for instance produced from a wood containing material.

The width of the downward tongue may lie between 1 and 3 times the radius of the second circle, and in particular may be about two times the radius of the second circle. When the width is about two times the radius, the width is about the diameter of the second circle. The provided ratio provides a relative shallow curvature of the rounded parts, enabling a relative easy coupling of adjacent panels.

Both above and below the second locking element the side of the downward tongue facing away from the downward flank may be at least partially oriented vertically. This way the second locking element as well as the side of the downward tongue onto which the locking element is present may be provided with an axis of symmetry. Such symmetry in turn may prove useful in the manufacture of the profiles, since a relative simple rotating tool could be used to produce the symmetric profile part.

In an embodiment of the invention the first locking element is in the form of a rounded bulge, and the second locking element is in the form of a rounded recess. The rounded bulge forms a first circular segment, wherein the centre of the first circle is located within the downward tongue. The rounded recess forms a second circular segment, wherein the centre of the second circle is located outside the downward tongue and/or, in a coupled condition, within the core of the adjacent panel. The other features in this embodiment substantially correspond, mutatis mutandis, to the features of the embodiment in which the first locking element is in the form of the rounded recess, and the second locking element is in the form of a rounded bulge.

The invention further relates to a covering, in particular a floor covering, comprising a plurality of interconnected panels according to the above.

The panel according to the invention is typically used to provide a floor covering, but can also be applied to form an alternative covering, for example a wall covering or a ceiling covering.

BRIEF DESCRIPTION OF THE DRAWINGS

The invention will be elucidated on the basis of non-limitative exemplary embodiments shown in the following figures. Herein.

DESCRIPTION OF THE INVENTION

Figure 1:
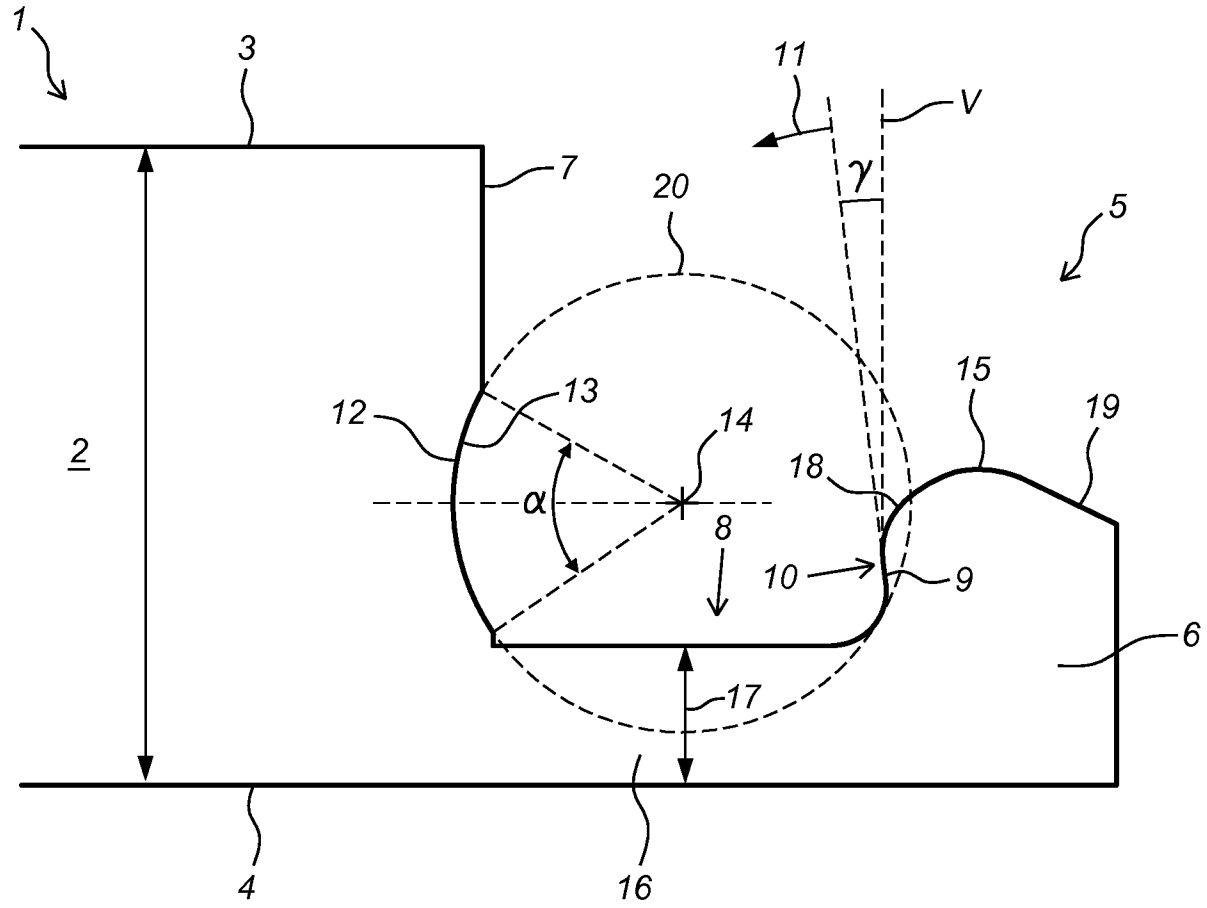
FIG. 1 schematically shows a panel and first coupling part according to the invention.

FIG. 1 schematically shows a panel (1), with a centrally located core (2) provided with an upper side (3) and a lower side (4). The panel (1) further comprises a first coupling part (5) connected to an edge of the core (2). The first coupling part (5) comprises an upward tongue (6), an upward flank (7) lying at a distance from the upward tongue (6) and an upward groove (8) formed in between the upward tongue (6) and the upward flank (7). The upward groove (8) is adapted to receive at least a part of a downward tongue of a second coupling part of an adjacent panel (1). A part (9) of a side (10) of the upward tongue (6) facing toward the upward flank (7) is inclined toward the upward flank (7), as indicated by the dotted line and arrow (11).

The upward flank (7) is provided with a first locking element (12) in the form of a rounded recess (12), configured to co-act with a locking element of an adjacent panel (1) in a coupled condition of two panels (1). The rounded recess (12) forms a first circular segment (13), wherein the centre (14) of the first circle (20) is located within the upward groove (8), wherein the angle (α) enclosed by the first circular segment (13) and the centre (14) is about 60 degrees. The angle (γ) enclosed by the inclined part (9) of the upward tongue (6) and the vertical (V) originating from the inclined part (9) may lie between 0 and 10 degrees, and is typically about 2.5 or 3 degrees.

The centre (14) of the first circle (20) is located below the upper side (15) of the upward tongue (6). The upward flank (7) is oriented substantially vertically and is provided with the rounded recess (12), in the shown figure such that both above and below the recess (12) a piece of upward flank (7) is present. The upward tongue (6) is connected to the core (2) of the panel (1) by a first bridge part (16), with a first maximal thickness (17). A part (18) of the side (10) of the upward tongue (6) facing towards the upward flank (7) may form an aligning edge (18), for aligning two panels (1) during coupling, and a part (19) of the upper side (15) of the upward tongue (6) may have an inclining orientation.

Figure 2:
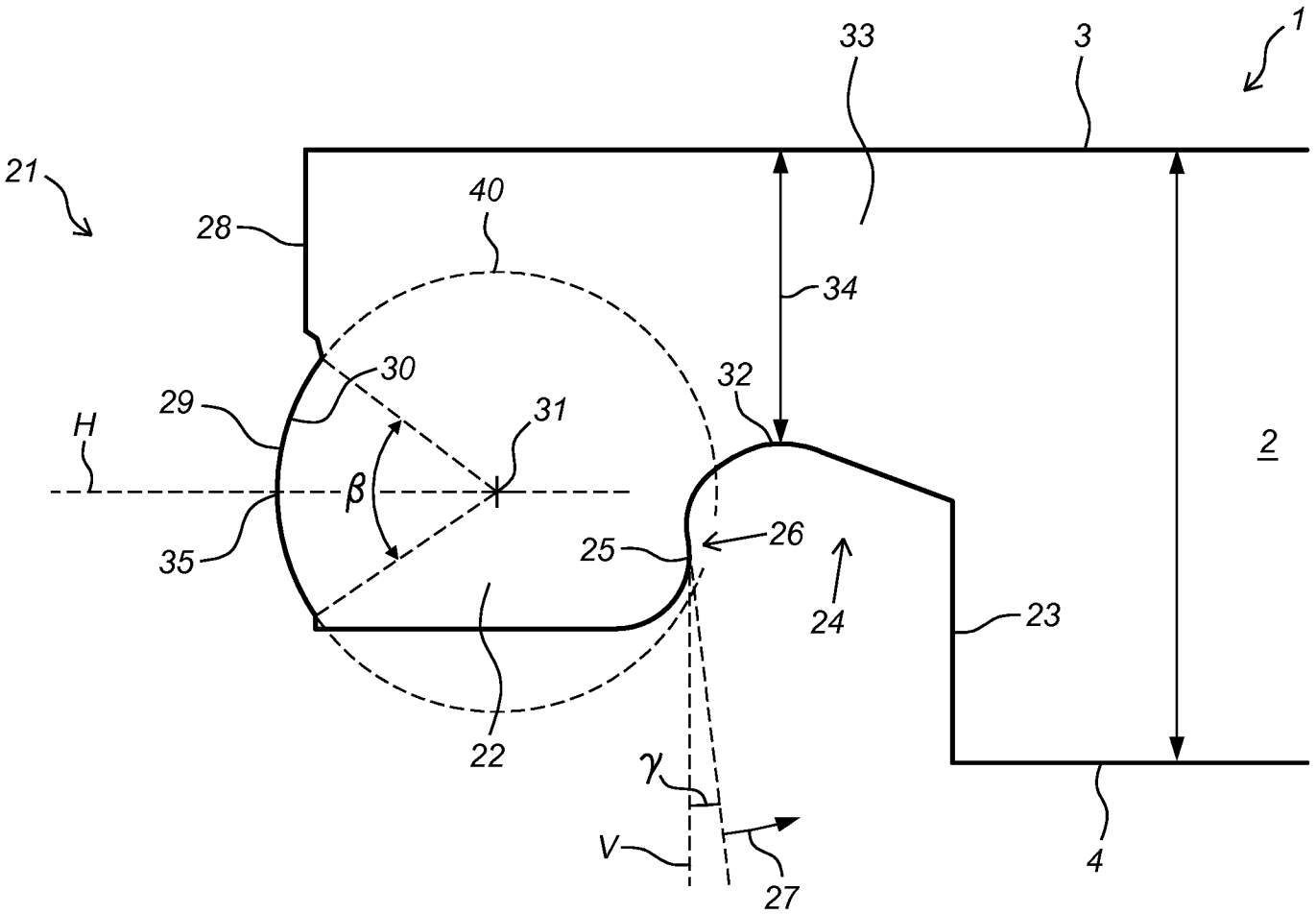
FIG. 2 schematically shows a panel and second coupling profile according to the invention.

FIG. 2 schematically shows a panel (1), with a centrally located core (2) provided with an upper side (3) and a lower side (4). The panel (1) further comprises a second coupling part (21) connected to an edge of the core (2), on an opposite side to the edge shown in FIG. 1. The second coupling part (21) comprises a downward tongue (22), a downward flank (23) lying at a distance from the downward tongue (22), and a downward groove (24) formed in between the downward tongue (22) and the downward flank (23). The downward groove (24) is adapted to receive at least a part of an upward tongue of a first coupling part of an adjacent panel (1). A part (25) of a side (26) of the downward tongue (22) facing toward the downward flank (23) is inclined toward the downward flank (23) as indicated by the dotted line and arrow (27).

The side (28) of the downward tongue (22) facing away from the downward flank (23) is provided with a second locking element (29), in the form of a rounded bulge (29), configured to co-act with a locking element of an adjacent panel (1) in a coupled condition of two panels (1). The rounded bulge (29) forms a second circular segment (30), wherein the centre (31) of the second circle (40) is located within the downward tongue (22), wherein the angle (β) enclosed by the first circular segment (30) and the centre (31) is about 65 degrees. The angle (γ) enclosed by the inclined part (25) of the downward tongue (22) and the vertical (V) originating from the inclined part (25) may lie between 0 and 10 degrees, and is typically about 2.5 or 3 degrees.

The centre (31) of the second circle (40) is located below the lower side (32) of the downward groove (24). The side (28) of the downward tongue (22) facing away from the downward flank (23) is oriented substantially vertically and is provided with the second locking element (29) in the form of the rounded bulge (29), in the shown figure such that both above and below the bulge (29) a piece of downward tongue (22) is present.

The downward tongue (22) is connected to the core (2) of the panel (1) by a second bridge part (33), with a second maximal thickness (34), being larger than the maximal thickness (17) of the first bridge part (16). The outermost part (35) of the second locking element (29) defines a horizontal level (H), wherein the centre (31) of the second circular segment (30) is located at said horizontal level (H). The downward flank (23) is shown substantially planar and free of locking elements.

Figure 3:
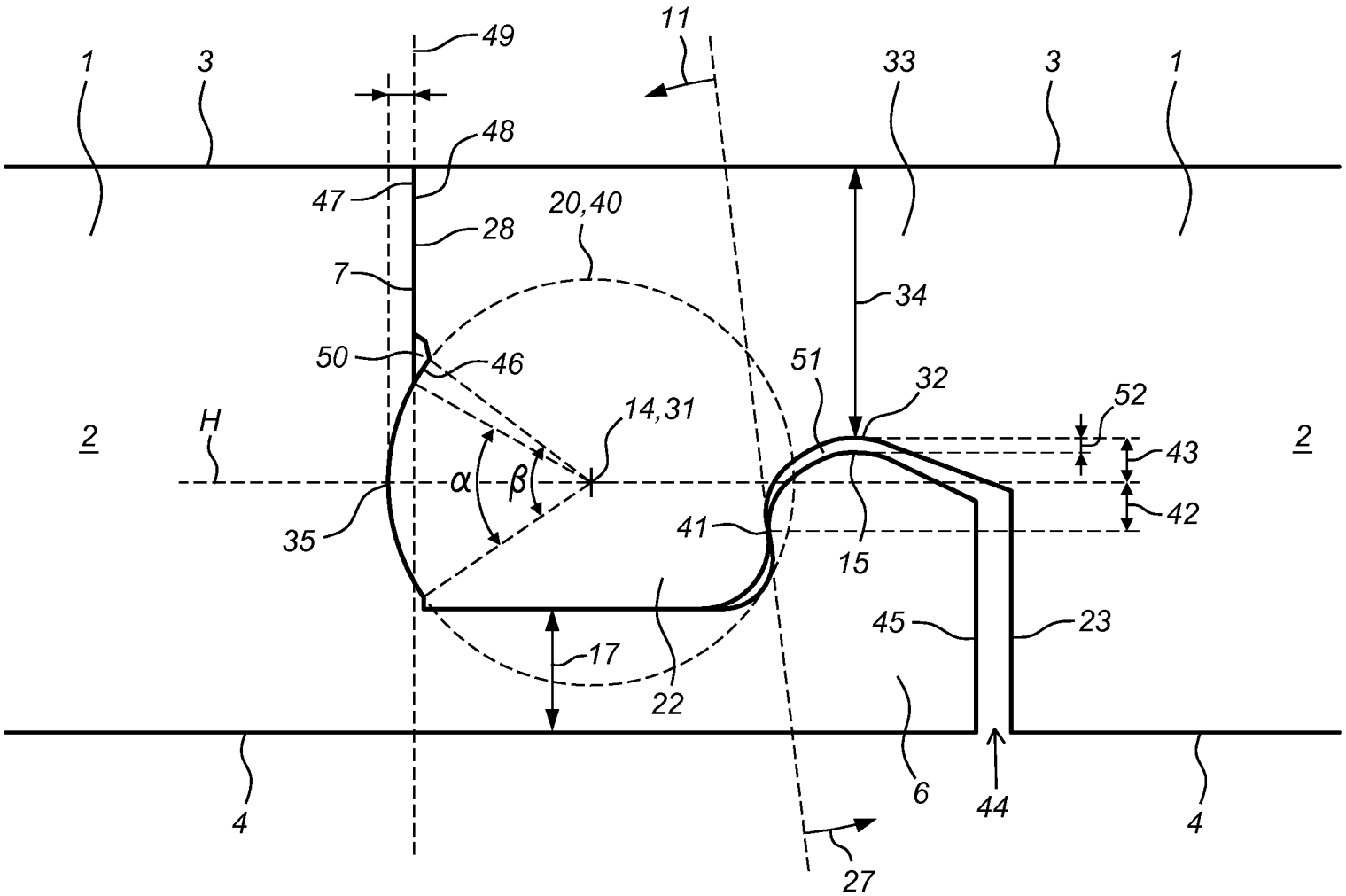
FIG. 3 schematically shows two panels in coupled condition.

FIG. 3 schematically shows two panels (1), as shown in FIGS. 1 and 2, in coupled condition, wherein the upward groove (8) of a panel (1) is receiving at least a part of a downward tongue (22) of the adjacent panel (1). The part (9) of the side (10) of the upward tongue (6) facing toward the upward flank (7) and the part (25) of the side (26) of the downward tongue (22) facing toward the downward flank (23) are in contact in a contact zone (41). The centre (14, 31) of the first (20) and second (40) circle is located above the contact zone (41), as indicated by arrow (42). The centre (14) of the first circle (20) is located below the upper side (15) of the upward tongue (6), as indicated by arrow (43).

The width of the downward groove (8) is larger compared to the width of the upward tongue (6), such that in coupled condition a space (44) exists between the downward flank (23) and a side (45) of the upward tongue (6) facing away from the upward flank (7).

The central angle (α) of the first circle segment (13) is less than the central angle (β) of the second circle segment (30), such that the second circle segment (30) is slightly larger than the first circle segment (13), resulting in a slight difference (46). In FIG. 3, the central angle (α) of the first circle segment (13) is about 60 degrees and the central angle (β) of the second circle segment (30) is about 65 degrees.

An upper part (47) of the upward flank (7) and an upper part (48) of the side (28) of the downward tongue (22) facing away from the downward flank (23) define a vertical plane (49) in coupled condition, wherein the distal part (35) of the second locking element (29) protrudes beyond the vertical plane (49). The centre (14, 31) of the first (13) and second (30) circular segment is located halfway the distance between the vertical plane (49) and the side (26) of the downward tongue (22) facing toward the downward flank (23). The second locking element (35) is located below the upper part (48) of the side (28) of the downward tongue (22) facing away from the downward flank (23) and an empty space (50) is provided between the upper part (48) of the downward tongue (22) and the second locking element (29). Another space (51) exists in coupled condition, since the upper side (15) of the upward tongue (6) and the lower side (32) of the downward groove (24) are spaced apart in coupled condition, indicated by arrow (52).

In an alternative embodiment, the first and second locking elements may be mirrored around the vertical plane, such that the downward tongue is provided with the rounded recess, and the upward flank with the rounded bulge.

It will be apparent that the invention is not limited to the working examples shown and described herein, but that numerous variants are possible within the scope of the attached claims that will be obvious to a person skilled in the art.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof.

The invention claimed is:

1. A panel, comprising:

a centrally located core provided with an upper side and a lower side, which core defines a plane;

at least one first coupling part and at least one second coupling part connected respectively to opposite edges of the core, which first coupling part comprises an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel, wherein:

at least a part of a side of the upward tongue facing toward the upward flank is inclined toward the upward flank;

which second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel, wherein:

at least a part of a side of the downward tongue facing toward the downward flank is inclined toward the downward flank, wherein the upward flank is provided with a first locking element in the form of a rounded recess, and wherein a side of the downward tongue facing away from the downward flank is provided with a second locking element, in the form of a rounded bulge, wherein the first locking element of a first panel and the second locking element of a second panel are configured to coact in a coupled condition of the two panels;

wherein the rounded recess forms a first circular segment, wherein a centre of a first circle that forms the first circular segment is located within the upward groove; and wherein the rounded bulge forms a second circular segment, wherein a centre of a second circle that forms the second circular segment is located within the downward tongue, and wherein a central angle of the first circular segment measured from the centre of the first circle lies between 30 and 70 degrees and/or wherein a central angle of the second circular segment measured from the centre of the second circle lies between 25 and 85 degrees.

2. The panel according to claim 1, wherein the centre of the first circle is located below the upper side of the upward tongue and/or wherein the centre of the second circle is located below an upper side of the downward groove.

3. The panel according to claim 1, wherein in coupled condition the part of the side of the upward tongue facing toward the upward flank and the part of a side of the downward tongue facing toward the downward flank are in contact in a contact zone, wherein the centre of the first and/or second circle is located above the contact zone.

4. The panel according to claim 1, wherein the upward flank is oriented substantially vertically and is provided with the first locking element in the form of the rounded recess and/or wherein the side of the downward tongue facing away from the downward flank is oriented substantially vertically and is provided with the second locking element in the form of the rounded bulge.

5. The panel according to claim 1, wherein the width of the downward groove is larger compared to the width of the upward tongue, such that in coupled condition a space exists between the downward flank and a side of the upward tongue facing away from the upward flank.

6. The panel according to claim 1, wherein the upward tongue is connected to the core of the panel by a first bridge part, and wherein the downward tongue is connected to the core of the panel by a second bridge part, wherein the maximal thickness of the first bridge part is less than the maximal thickness of the second bridge part.

7. The panel according to claim 1, wherein a central angle of the first circular segment is less than a central angle of the second circular segment, wherein the central angle of the first circular segment is about 60 degrees, and wherein the central angle of the second circular segment is about 65 degrees.

8. The panel according to claim 1, wherein an upper part of the upward flank and an upper part of a side of the downward tongue facing away from the downward flank define a vertical plane in coupled condition, and wherein the distal part of the second locking element protrudes beyond the vertical plane, wherein the centre of the first and/or second circular segment is located halfway the distance between the vertical plane and the side of the downward tongue facing toward the downward flank.

9. The panel according to claim 1, wherein the outermost part of the second locking element defines a horizontal level, wherein the centre of the first and/or second circular segment is located at said horizontal level.

10. The panel according to claim 1, wherein an upper part of the upward flank and an upper part of a side of the downward tongue facing away from the downward flank define a vertical plane in coupled condition, wherein the second locking element is located below the upper part of the side of the downward tongue facing away from the downward flank and wherein an empty space is provided between the upper part of the side of the downward tongue facing away from the downward flank and the second locking element.

11. The panel according to claim 1, wherein the total thickness of the panel is between 1.5 and 5 times the radius of the circular segment.

12. The panel according to claim 1, wherein the part of a side of the upward tongue facing toward the upward flank, which is inclined toward the upward flank, and the side of the downward tongue facing toward the downward flank, which is inclined toward the downward flank, define a closed groove system, wherein the part of the side of the upward tongue facing toward the upward flank is directed upward towards the upper side of the panel, and wherein the side of the downward tongue facing toward the downward flank is directed downward towards the bottom side of the panel.

13. The panel according to claim 1, wherein the downward flank is substantially planar and free of locking elements.

14. The panel according to claim 1, wherein the upper side of the upward tongue and the upper side of the downward groove are spaced apart in coupled condition.

15. The panel according to claim 1, wherein the width of the downward tongue lies between 1 and 3 times the radius of the second circle.

16. The panel according to claim 1, wherein both above and below the second locking element the side of the downward tongue facing away from the downward flank is at least partially oriented vertically.

17. Covering, comprising a plurality of interconnected panels according to claim 1.

* * * * *